US008600252B2

(12) United States Patent
Tsukioka

(10) Patent No.: US 8,600,252 B2
(45) Date of Patent: Dec. 3, 2013

(54) SYSTEM AND METHOD FOR CONTROLLING OPERATION OF A FIXING DEVICE IN AN IMAGE FORMING APPARATUS

(75) Inventor: Yasutada Tsukioka, Yokohama (JP)

(73) Assignee: Ricoh Company, Limited, Tokyo (JP)

( * ) Notice: Subject to any disclaimer, the term of this patent is extended or adjusted under 35 U.S.C. 154(b) by 276 days.

(21) Appl. No.: 12/929,963

(22) Filed: Feb. 28, 2011

(65) Prior Publication Data

US 2011/0222886 A1 Sep. 15, 2011

(30) Foreign Application Priority Data

Mar. 15, 2010 (JP) ..... 2010-058500

(51) Int. Cl.
*G03G 15/20* (2006.01)

(52) U.S. Cl.
USPC ..... 399/68; 399/328; 399/329; 399/330

(58) Field of Classification Search
USPC ..... 399/68, 328–330
See application file for complete search history.

(56) References Cited

U.S. PATENT DOCUMENTS

| | | | | |
|---|---|---|---|---|
| 5,758,245 | A * | 5/1998 | Matsuura et al. | 399/329 |
| 7,127,186 | B2 * | 10/2006 | Fujita et al. | 399/45 |
| 7,167,659 | B2 * | 1/2007 | Fujita et al. | 399/67 |
| 7,361,863 | B2 * | 4/2008 | Tsunoda | 219/216 |
| 7,783,220 | B2 * | 8/2010 | Tateishi et al. | 399/70 |
| 2007/0059005 | A1 * | 3/2007 | Fujita et al. | 399/45 |
| 2007/0059059 | A1 * | 3/2007 | Fujino | 399/329 |
| 2007/0230983 | A1 * | 10/2007 | Nakamoto et al. | 399/69 |
| 2007/0230984 | A1 * | 10/2007 | Noguchi | 399/69 |
| 2007/0258740 | A1 * | 11/2007 | Tsueda et al. | 399/328 |
| 2007/0292154 | A1 * | 12/2007 | Ishikuro et al. | 399/67 |
| 2008/0131158 | A1 * | 6/2008 | Kikuchi | 399/69 |
| 2008/0131161 | A1 * | 6/2008 | Kikuchi | 399/70 |
| 2009/0129797 | A1 * | 5/2009 | Suzuki et al. | 399/44 |
| 2009/0317159 | A1 * | 12/2009 | Tsueda et al. | 399/333 |
| 2010/0226700 | A1 * | 9/2010 | Yamada et al. | 399/329 |
| 2010/0272458 | A1 * | 10/2010 | Yoshikawa | 399/68 |
| 2010/0303496 | A1 * | 12/2010 | Mukai | 399/70 |
| 2010/0310289 | A1 * | 12/2010 | Someya et al. | 399/329 |

FOREIGN PATENT DOCUMENTS

| | | | |
|---|---|---|---|
| JP | 09179435 | A | 7/1997 |
| JP | 2002351237 | A | 12/2002 |
| JP | 2007309982 | A * | 11/2007 |
| JP | 2007310129 | A | 11/2007 |

* cited by examiner

*Primary Examiner* — G. M. Hyder
(74) *Attorney, Agent, or Firm* — Harness, Dickey & Pierce

(57) ABSTRACT

A fixing device includes a fixing member, a pressing member, and a driving unit. The fixing member and the pressing member define a nip portion where a toner image is fixed on a recording material. The driving unit is provided to the fixing member and the pressing member to individually control linear velocities of outer circumferential surfaces of the fixing member and the pressing member. In feed mode in which the outer circumferential surfaces sandwich the recording material to fix the image on the recording material, the driving unit drives the fixing member and the pressing member such that the outer circumferential surfaces move at individual linear velocities to reduce a feed speed difference between front and rear surfaces of the recording material. In non-feed mode, the driving unit drives either one of the fixing member and the pressing member such that another member is driven by the one member.

8 Claims, 5 Drawing Sheets

FIG. 6

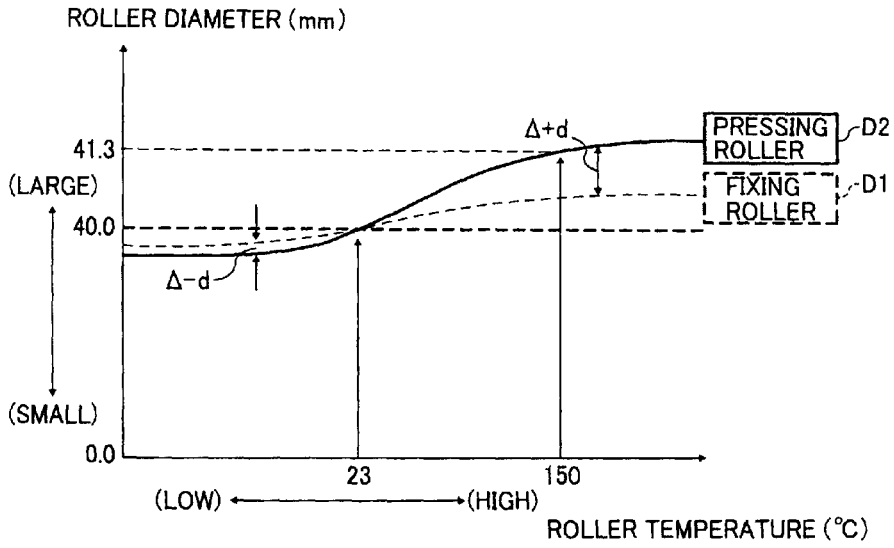

FIG. 7

| TYPE OF PASSED PAPER | BASIS WEIGHT (g/m²) | SURFACE OF PASSED PAPER | ROTATIONAL SPEED OF FIXING ROLLER (Nto/Ntoj) | ROTATIONAL SPEED OF PRESSING ROLLER (Nco/Ncoj) | REMARKS |
|---|---|---|---|---|---|
| THICK PAPER | 105 - | FIRST SIDE | 106.964 rpm | 103.848 rpm | -0.03% |
| | | SECOND SIDE | 106.964 rpm | 110.173 rpm | 0.03% |
| ORDINARY PAPER | 66-104 | FIRST SIDE | 119.366 rpm | 119.366 rpm | ±0.00% |
| | | SECOND SIDE | 119.366 rpm | 125.334 rpm | 0.03% |
| THIN PAPER | - 65 | FIRST SIDE | 119.366 rpm | 119.366 rpm | ±0.00% |
| | | SECOND SIDE | 119.366 rpm | 119.366 rpm | ±0.00% |
| COATED PAPER | - | FIRST SIDE | 119.366 rpm | 115.889 rpm | -0.03% |
| | | SECOND SIDE | 119.366 rpm | 112.947 rpm | 0.03% |
| ENVELOPE | - | FIRST SIDE | 59.683 rpm | 59.683 rpm | ±0.00% |
| | | SECOND SIDE | 59.683 rpm | 59.683 rpm | ±0.00% |

SYSTEM AND METHOD FOR CONTROLLING OPERATION OF A FIXING DEVICE IN AN IMAGE FORMING APPARATUS

CROSS-REFERENCE TO RELATED APPLICATIONS

The present application claims priority to and incorporates by reference the entire contents of Japanese Patent Application No. 2010-058500 filed in Japan on Mar. 15, 2010.

BACKGROUND OF THE INVENTION

1. Field of the Invention

The present invention relates to a fixing device applied to an image forming apparatus, which fixes a toner image on a recording material passing through a nip between a fixing roller and a pressing roller, and the image forming apparatus.

2. Description of the Related Art

Conventional electrophotographic image forming apparatuses, such as copiers, laser printers, plotters, and facsimile machines, are configured to first read an original image by a scanner, and then expose the original image to light to form an electrostatic latent image on the electrostatic latent image carrier of the image forming unit. The electrostatic latent image is developed to a visible toner image. This toner image is transferred onto a recording material fed from the recording material supply unit. There are various types of recording materials such as recording sheets or envelopes. The transferred toner image is fixed onto the recording material to be discharged to the discharging unit or the like.

The image forming unit of such an image forming apparatus often uses a fixing device configured to apply heat and pressure by pressing the fixing member and the pressing member against each other. For example, Japanese Patent Application Laid-open No. H09-179435 discloses a conventional fixing device which includes a fixing roller as the fixing member with an internal heat source and a pressing roller as the pressing member. The fixing roller and the pressing roller are first brought into pressurized contact with each other and rotated. The rollers sandwich a recording material arrived at the pressurized contact portion or at the nip defined by the rollers and feed it at a predetermined speed. At this time, the rollers heat and press an unfixed toner image onto the recording material to fix the toner image as a visible image on the image surface.

Incidentally, it is effective to control the linear speed of each of the front and rear surfaces of a recording material to achieve a higher degree of flexibility related to fixing performance to fix a toner image reliably onto the image surface of the recording material depending on the type of the recording material and feed it at a predetermined speed in the discharge direction.

In the fixing process by application of heat and pressure, for example, such a fixing device is used in which either one of the fixing roller and the pressing roller is rotationally driven by a driver as a driving roller, and the other is driven by the driving roller.

In this case, when a thin sheet (recording material) having a basis weight of, for example, 65 g/m$^2$ or less passes through the nip defined between the rollers, a slip occurs on the driven side. Besides, when a recording material made of two or more sheets combined together such as an envelope passes through the nip, the front and rear sides of the envelope facing the driving roller and driven roller, respectively, are fed at different speeds (linear velocities). This may cause stoppage of feed, unsettlement of images, feed wrinkles.

On the other hand, when a thick sheet having a basis weight of 200 g/m$^2$ or more passes through the nip, neither slip on the driven side nor relative variations in feed speed (linear velocity) on the front and rear sides of the sheet occurs. However, the fixing member and the pressing member may define a curved nip, which causes curling of the sheet and may degrade the feed performance and stackability after printing.

To ensure that an image can be fixed on various types of recording materials (types of sheets) without slippage in fixing and rubbing of images, several attempts have been made. As examples of such attempts, the fixing member and the pressing member are driven via an idler wheel by the same driving source. The shape of the nip is flattened depending on the material and shape of the fixing member and the pressing member. The setting direction is regulated and the pressure is reduced depending on the recording material.

Japanese Patent Application Laid-open No. H9-179435 discloses an example of the technology. According to the conventional technology, when recording materials sequentially pass through the pressurized contact portion between the heating member and the pressure contact member, a drum effect increases by an increase in temperature on the axial periphery of the pressurized contact portion through which no recording material passes. At this time, the pressure applied by the pressure contact unit is reduced to thereby decrease the relative speed difference between the heating member and the pressure contact member. This alleviates the drum effect, thus preventing images from being rubbed or granulated.

Japanese Patent Application Laid-open No. 2002-351237 discloses another conventional technology in which a first fixing unit and a second fixing unit are arranged in the feed direction. The first and second fixing units are provided on the pressing roller side with a driving unit. The driving unit transmits a driving force in the form of frictional force to the heating member and the fixing roller, thereby causing them to be rotationally driven to sequentially fix an image and ensure the quality of gloss of the image surface.

Japanese Patent Application Laid-open No. 2007-310129 discloses conventional image forming apparatus including a fixing film that slides along a heater holder that integrally includes a heater and is driven by the rotational force of the pressing roller. In the image forming apparatus, a slip may occur in the flat nip between the pressing roller and the fixing film at a low temperature of the pressing roller in pressurized contact with the fixing film, while a slip occurs less at a high temperature. Further, a sheet is not pulled when a loop is detected which is caused by a slack of the sheet between the fixing nip and the transfer nip located upstream thereof on the feed path, while when no loop exists and the sheet is pulled, a slip is likely to occur during fixing. Taking these characteristics into account, slip prevention is performed when a slip is likely to occur during fixing and otherwise unnecessary slip prevention is not performed.

With the above conventional technologies, a driving force of the pressure contact member (pressing member) is transmitted to the heating member (fixing member) via an idler wheel to drive the fixing member and the pressing member together with the driving force from the same driving source. However, only this configuration is not enough to offer constant flexibility during fixing of images on various types of recording materials (types of sheet) to, for example, prevent slip during fixing and rubbing of images as well as to maintain durability without reducing the service life of the fixing member and the pressing member.

In the case of the image forming apparatus as disclosed in Japanese Patent Application Laid-open No. 2007-310129 having a flat nip and the fixing film to be rotationally driven, if a low heat capacity member is used for the fixing unit to achieve the recent trend of energy saving, it is difficult to form the nip with a width enough to ensure a sufficient amount of heat. Moreover, a drop in pressure requires to drop the linear speed accordingly to ensure a necessary amount of heat, thereby hampering productivity.

Furthermore, it is inconvenient that there are restrictions on the setting direction of the recording material and a particular type of sheet such as an envelope, the setting direction of which cannot be selected, cannot be handled.

SUMMARY OF THE INVENTION

It is an object of the present invention to at least partially solve the problems in the conventional technology.

According to an aspect of the present invention, fixing device includes a fixing member, a pressing member, and a driving unit. The fixing member includes a heating unit. The pressing member includes a heating unit. The fixing member and the pressing member define a nip portion where an unfixed toner image is fixed on an image surface of a recording material. The driving unit is provided to the fixing member and the pressing member to individually control linear velocities of outer circumferential surfaces of the fixing member and the pressing member. In feed mode in which the outer circumferential surfaces sandwich the recording material to fix the image on the recording material, the driving unit drives the fixing member and the pressing member such that the outer circumferential surfaces move at individual linear velocities to reduce a feed speed difference between front and rear surfaces of the recording material. In non-feed mode, the driving unit drives either one of the fixing member and the pressing member such that another member is driven by the one member.

According to an aspect of the present invention, an image forming apparatus includes a fixing device including a fixing member, a pressing member, and a driving unit. The fixing member includes a heating unit. The pressing member includes a heating unit. The fixing member and the pressing member define a nip portion where an unfixed toner image is fixed on an image surface of a recording material. The driving unit is provided to the fixing member and the pressing member to individually control linear velocities of outer circumferential surfaces of the fixing member and the pressing member. In feed mode in which the outer circumferential surfaces sandwich the recording material to fix the image on the recording material, the driving unit drives the fixing member and the pressing member such that the outer circumferential surfaces move at individual linear velocities to reduce a feed speed difference between front and rear surfaces of the recording material. In non-feed mode, the driving unit drives either one of the fixing member and the pressing member such that another member is driven by the one member.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 6 is a diagram of temperature variation characteristics of the outer diameter of the fixing roller and the pressing roller of the fixing device of FIG. 1;

FIG. 7 is a table of control velocity characteristics according to temperature changes of the fixing roller and the pressing roller of the fixing device of FIG. 1.

DETAILED DESCRIPTION OF THE PREFERRED EMBODIMENTS

Exemplary embodiments of the present invention will be described in detail below with reference to the accompanying drawings.

First, the configuration and operation of a fixing device according to a first embodiment and the image forming apparatus including the fixing device will be described with reference to FIGS. 1 to 4.

Here, prior to describing the fixing device of FIG. 1, the overall configuration of a printer M1 of FIG. 3 serving as an image forming apparatus will be described.

Figure 3:
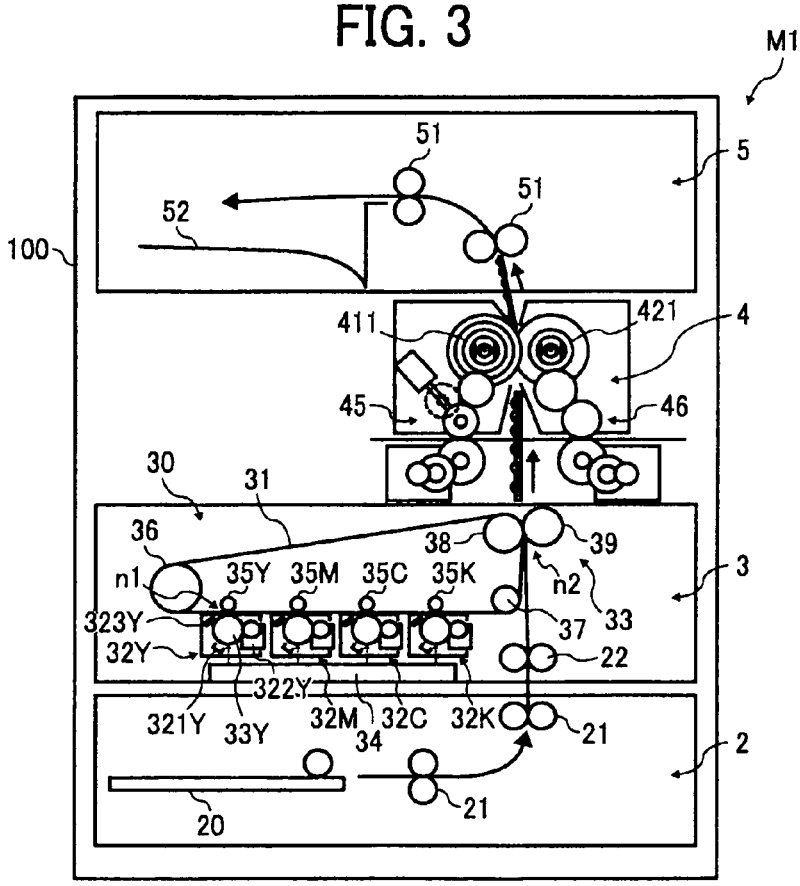
FIG. 3 is a view of the overall configuration of an image forming apparatus incorporating the fixing device of FIG. 1.

As shown in FIG. 3, the main body of an image forming apparatus 100 (hereinafter also referred to as "apparatus main body 100") includes a sheet feeding device 2, a transfer device 3, a fixing device 4, and a discharging unit 5, which are provided upwardly one above another in this order.

At a lower portion of the apparatus main body 100, the sheet feeding device 2 includes a sheet feeding unit 20 in which a plurality of recording materials P (generic name for transfer materials like transfer paper, recording sheets, OHP film sheets, or envelopes) are stacked in place. The sheet feeding unit 20 feeds a recording sheet P to the transfer device 3 via a plurality of feeding rollers 21 and a subsequent pair of registration rollers 22. Note that provided in parallel with the sheet feeding device 2 are a plurality of types of feeding trays (not shown) which are disposed at a plurality of places in the apparatus main body 100. This arrangement allows a plurality of types of recording materials to be fed as required to the transfer device 3.

The transfer device 3 includes an intermediate transfer belt device 30 located at the center of the apparatus main body 100. Further included are image forming units 32Y, 32M, 32C, and 32K which are associated with respective colors (yellow, magenta, cyan, and black), and disposed in parallel with an intermediate transfer belt 31 (an intermediate transfer body or belt member) to face each other. The intermediate transfer belt 31 constitutes the main portion of the intermediate transfer belt device 30. Also included in the transfer device 3 is a transfer unit 33 that faces a feed path R for recording materials.

The image forming unit 32Y associated with the yellow color is configured to include a photosensitive element 33Y serving as an image carrier, a charging unit 321Y disposed around the photosensitive element 33Y, an exposing unit 34, a developing unit 322Y, a cleaning unit 323Y, a static eliminator (not shown), and the like. This configuration allows for performing an image forming process (including each function to be carried out by the charging Unit, the exposing unit, the developing unit, the transfer unit, and the cleaning unit) on the photosensitive element 33Y, thereby forming yellow images on the photosensitive element 33Y.

Note that the other three image forming units 32M, 32C, and 32K have almost the same configuration as that of the yellow image forming unit 32Y except that the different toner colors are used, and form images associated with the respective toner colors. Hereafter, a description will be made only to the yellow image forming unit 32Y while the three image forming units 32M, 32C, and 32K will be omitted from the discussions below, where applicable.

Figure 1:
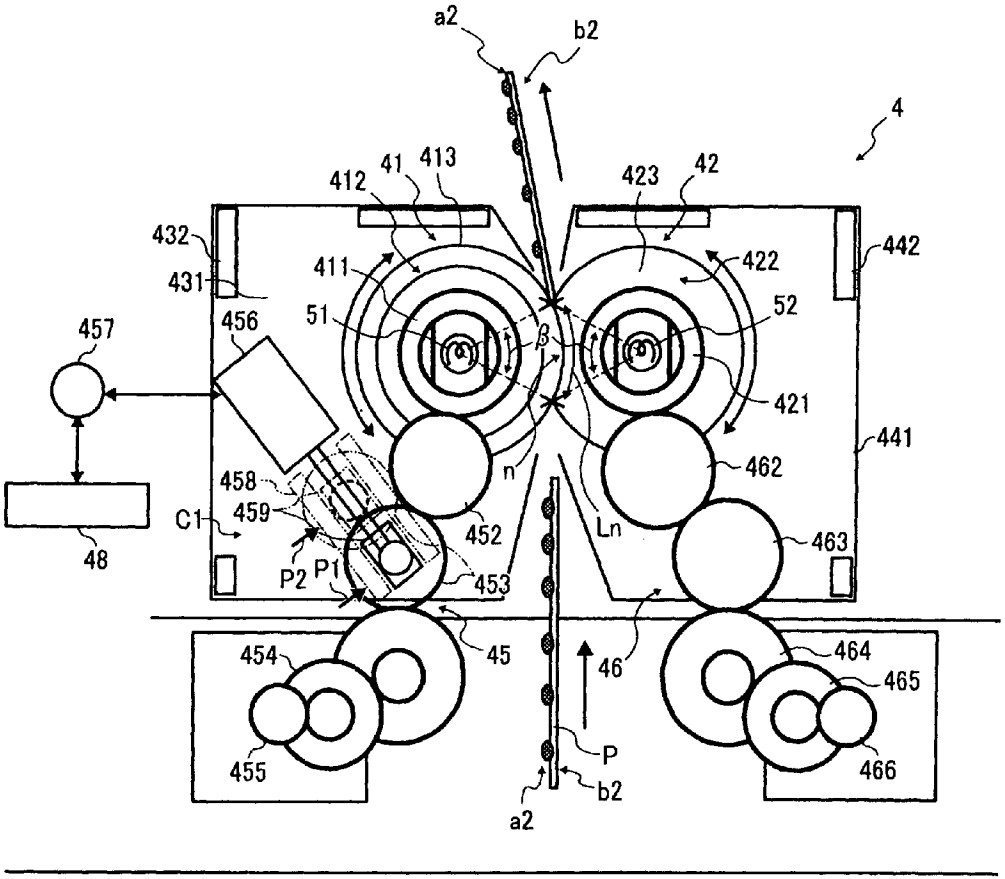
FIG. 1 is an enlarged cross-sectional side view of a fixing device according to an embodiment of the present invention.

As shown in FIG. 1, the photosensitive element 33Y is rotationally driven by a driving motor (not shown) in a clockwise direction in FIG. 1, and then, at the position of the charging unit 321Y, the surface of the photosensitive element 33Y is uniformly charged (the step of charging). Then, the surface of the photosensitive element 33Y is exposed to a laser beam L emitted from the exposing unit 34Y while being scanned therewith, to form an electrostatic latent image associated with the yellow color (the step of exposure to light). After that, the electrostatic latent image on the surface of the photosensitive element 33Y is developed at the developing unit 322Y to form a yellow toner image (the step of development). Subsequently, the toner image on the photosensitive element 33Y is transferred to the intermediate transfer belt 31 at a position opposite to the intermediate transfer belt 31 and a transfer roller 35Y (a primary transfer roller) (the step of primary transfer).

After that, on the surface of the photosensitive element 33Y, untransferred toner remaining on the photosensitive element 33Y is collected at the cleaning unit 323Y with a cleaning blade into a collecting unit (not shown) (the step of cleaning). Then, the residual electric potential of the surface of the photosensitive element 33Y is eliminated at the static eliminator (not shown).

In this manner, the series of steps to be performed on the photosensitive element 33Y in the image forming process are ended.

Note that the aforementioned image forming process is also conducted in the other image forming units 32M, 32C, and 32K in the same manner as in the yellow image forming unit 32Y. That is, the exposing unit 34 disposed near these image forming units irradiates each of photosensitive elements 33M, 33C, and 33K in the respective image forming units 32M, 32C, and 32K with the laser beam L based on image information. Next, after the step of development, the toner image of each color formed on each of the photosensitive elements 33M, 33C, and 33K is sequentially transferred one on another on the intermediate transfer belt 31. In this manner, a color image is formed on the intermediate transfer belt 31.

Here, the intermediate transfer belt device 30 is configured to include the intermediate transfer belt 31, the four transfer rollers 35Y, 35M, 35C, and 35K serving as a primary transfer roller, a driving roller 36, tension rollers 37 and 38, an intermediate transfer cleaning unit (not shown), and the like.

The intermediate transfer belt 31 is supported and tensioned by a plurality of rollers 36, 37, and 38, and rotationally driven to run endlessly by one of the rollers (driving roller) 36 in the direction indicated with the arrow in FIG. 3.

The four transfer rollers 35Y, 35M, 35C, and 35K (primary transfer rollers) form a primary transfer nip to sandwich the intermediate transfer belt 31 between these rollers and the photosensitive elements 33Y, 33M, 33C, and 33K, respectively. Then, a high-pressure voltage (transfer bias), opposite in polarity to the toner, is applied to the transfer rollers 35Y, 35M, 35C, and 35K.

Then, the intermediate transfer belt 31 runs in the direction indicated with the arrow in FIG. 3 to pass sequentially through the primary transfer nips defined by the transfer rollers 35Y, 35M, 35C, and 35K. In this manner, the toner image of each color on the photosensitive elements 33Y, 33M, 33C, and 33K is primarily transferred sequentially one on another on the intermediate transfer belt 31.

After that, the intermediate transfer belt 31 on which the toner image of each color has been transferred one on another reaches a position opposite to the tension roller 38. At this position, the tension roller 38 and a secondary transfer roller 39 sandwich the intermediate transfer belt 31 therebetween, thus forming a secondary transfer nip N2. Then, a high-pressure voltage (a secondary transfer bias), opposite in polarity to the toner, is applied to the secondary transfer roller 39. Thus, the toner image of four colors formed on the intermediate transfer belt 31 is transferred to a recording material P fed to the position of the secondary transfer nip N2 (the step of secondary transfer). Note that the intermediate transfer belt 31 reaches the position of the intermediate transfer cleaning unit (not shown), where untransferred toner on the intermediate transfer belt 31 is removed.

In this manner, the series of steps to be performed on the intermediate transfer belt 31 in the transfer process are ended.

The recording material P is then fed through a pair of registration rollers 22 into the secondary transfer nip N2 between the tension roller 38 and the secondary transfer roller 39 facing the intermediate transfer belt 31 that is wound around the tension roller 38.

Here, the recording material P having been fed to the pair of registration rollers 22 stops once at the position of the roller nip between the pair of registration rollers 22 that have stopped their driving rotary motion. Then, in sync with the operational timing of the color image on the intermediate transfer belt 31, the pair of registration rollers 22 are rotationally driven, thereby feeding the recording material P to the secondary transfer nip N2. In this manner, a desired color image is collectively transferred onto the recording material P.

After that, the sheet P onto which a color image has been transferred at the position of the secondary transfer nip N2 is fed to the position of the fixing device 4.

At this position, the toner image of four colors is fixed onto the surface (image surface) of the recording material by the heat and pressure that are supplied by a fixing roller 41 and a pressing roller 42. Here, the fixing roller 41 serving as a fixing member, and the pressing roller 42 serving as a pressing member constitute the fixing device 4. Note that the configuration and operation of the fixing device 4 will be discussed in more detail later.

Next, the recording material P is fed to the discharging unit 5. The discharging unit 5 includes a plurality of pairs of ejecting rollers 51 and a discharging tray 52, which are located at the downstream end of the feed path R, and works to discharge the recording material P out of the fixing device 4. The recording materials P discharged by the pairs of ejecting rollers 51 out of the device into the discharging tray 52 are sequentially stacked in the discharging tray 52.

Now, the fixing device 4 incorporated in the image forming apparatus to perform the series of steps in the image forming process will be described in more detail below.

As shown in FIG. 1, the fixing device 4 includes: a fixing side main body 43; a pressing side main body 44 disposed opposite and integrally coupled to the fixing side main body 43; the fixing roller 41 pivotally supported by the fixing side main body 43 to serve as a heating member; the pressing roller 42 serving as a pressing member in pressurized contact with the fixing roller 41; a fixing drive unit 45 for transmitting rotational driving force to the fixing roller 41; a pressing drive unit 46 for transmitting rotational driving force to the pressing roller 42; and a control unit 48 for controllably driving each of these units.

The fixing side main body 43 includes a pair of right and left vertical walls 431 located near both side ends in the direction of width of the feed path R (only one of the walls is indicated in FIG. 1). Also included are a plurality of frame members 432 for linking together a plurality of mutually opposing portions of the rims of these right and left vertical walls 431 along the width of the feed path R (in the direction perpendicular to the plane of FIG. 1).

Likewise, the pressing side main body 44 includes a pair of right and left vertical walls 441 located near both side ends in the direction of width of the feed path R (only one of the walls is indicated in FIG. 1). Further included are a plurality of frame members 442 for linking together a plurality of mutually opposing portions of the rims of these right and left vertical walls 441 along the width of the feed path R (in the direction perpendicular to the plane of FIG. 1). Note that the fixing side main body 43 and the pressing side main body 44 are integrally coupled to each other at such a location as not to interfere with the feed path R.

The fixing roller 41 is pivotally supported by shaft bearings (not shown) between the right and left vertical walls 431 of the fixing side main body 43. One end of the rotating shaft of the fixing roller 41 is provided with a fixing drive gear 411, to which the fixing drive unit 45 to be described later is coupled.

Here, the fixing roller 41 is formed as a roller of an outer diameter of ϕ40 by winding a sheet of silicon rubber, which is 1 mm in thickness and serves as an elastic layer 412, around a hollow metal core 411 such as of steel or aluminum. Likewise, the pressing roller 42 is formed as a roller of an outer diameter of ϕ40 by winding a sheet of silicon rubber, which is 3 mm in thickness and serves as an elastic layer 422, around a hollow metal core 421. The surface layer portions 413 and 423 of both the rollers are formed to have a PFA or PTFE layer.

Both the fixing roller 41 and the pressing roller 42 have heating units 51 and 52 with a halogen heater disposed within the hollow metal cores 411 and 421, respectively. These heaters are connected to the control unit 48 via a heater drive circuit 53. Note that alternatively other units such as IH coils or planar heating elements may also be employed as the heating unit.

As shown in FIG. 1, the pressing roller 42 is provided with the elastic layer 422 that is relatively thick (3 mm in thickness and relatively soft) and brought into pressurized contact with the elastic layer 412 of the fixing roller 41 that is relatively thin (1 mm in thickness and relatively hard). This contact allows a nip n projected toward the pressing roller 42 to be formed.

Both the fixing roller 41 and the pressing roller 42 are 40 mm in outer diameter, and arranged to form a central angle β of about 45 degrees subtended at the center of each roller by the width Ln of the nip n in the direction of feed. This relatively large width Ln thus formed makes it possible to increase the period of heating and fixing time, thereby providing further improved fixability.

Note that the nip n can be more advantageously curved to be projected as shown in FIG. 1 than formed to be flat. This is because the projected nip n substantially provides an increased width Ln, and this increase in width allows an elongated period of heating and fixing time and improved fixability.

Figure 5:
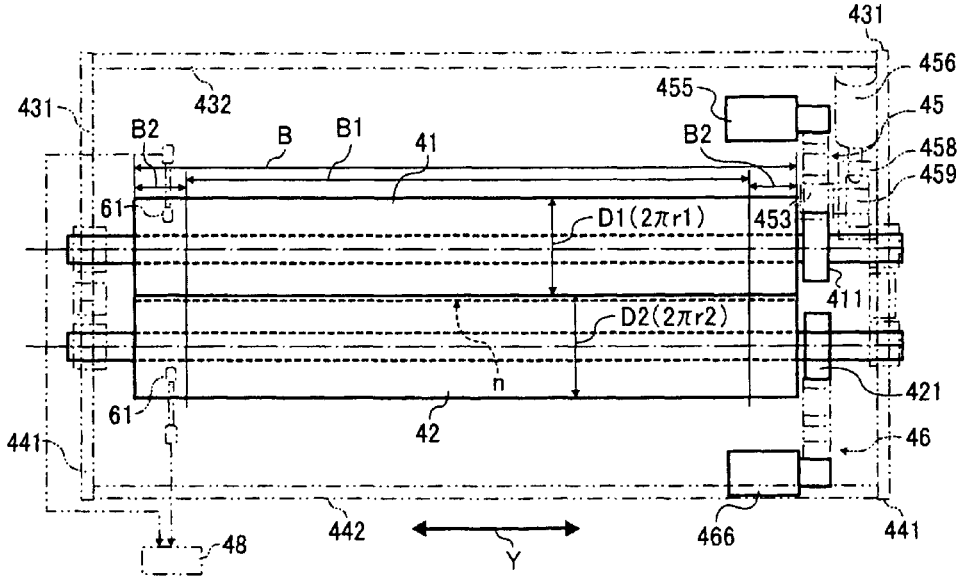
FIG. 5 is a schematic plan view of the fixing roller and the pressing roller of the fixing device of FIG. 1 and their peripheral members.

As shown in FIG. 5, in non-feed mode, the outer circumferential surfaces of the fixing roller 41 and the pressing roller 42 contact with each other with the maximum width B in their respective axial direction Y (the direction of width orthogonal to the feed path R), thereby mutually transmitting rotational force in the direction of feed.

A description will be made to the fixing drive unit 45 and the pressing drive unit 46 which are coupled to the fixing drive gear 411 of the fixing roller 41 and the pressing drive gear 421 of the pressing roller 42.

Here, the pressing drive unit 46 provides driving force for the pressing roller 42 to rotate at a linear velocity v2, while the fixing drive unit 45 does so for the fixing roller 41 to rotate at a linear velocity of v1.

First, the fixing drive unit 45 controllably drives the fixing drive gear 411 (see FIG. 5) which is integrated with one end of the rotating shaft of the fixing roller 41 that is pivotally supported between the right and left vertical walls 431 (only one of the walls is indicated in FIG. 1) of the fixing side main body 43.

The fixing drive unit 45 is configured to include a fixing idler wheel gear 452 always mating with the fixing drive gear 411 integrated with the fixing roller 41, a movable idler wheel gear 453 mating therewith, a plurality of reduction gears 454, and a stepping motor 455 for applying rotational force thereto. There is also provided a switching unit C1 for switching a the movable idler wheel gear 453 between a connection point P1 and a separation point P2.

Here, the rotating shaft of the movable idler wheel gear 453 is movably supported via a slider 459 by a guide rail 458 of the right and left vertical walls 431. The slider 459 is switchably coupled to an electromagnetic solenoid 456 supported by the right and left vertical walls 431. Here, the electromagnetic solenoid 456 is coupled to the control unit 48 via a driving circuit 457, and switches the movable idler wheel gear 453 between the connection point p1 and the separation point p2 according to a connection/separation signal from the control unit 48. At the connection point P1, the rotary motion of the stepping motor 455 can be transmitted to the fixing roller 41, whereas at the separation point P2, the fixing roller 41 can be separated from the stepping motor 455 for idle running.

On the other hand, the pressing drive unit 46 controllably drives the pressing drive gear 421 which is integrated with one end of the rotating shaft of the pressing roller 42 that is pivotally supported between the right and left vertical walls 441 (see FIG. 5) of the pressing side main body 44.

The pressing drive unit 46 includes two-stage fixing idler wheel gears 462 and 463 always mating with the pressing drive gear 421, a plurality of reduction gears 464 and 465, and a stepping motor 466 for supplying rotational force thereto.

A description will be made to the fixing roller 41 and the pressing roller 42 which are driven by the fixing drive unit 45 and the pressing drive unit 46.

Figure 4:
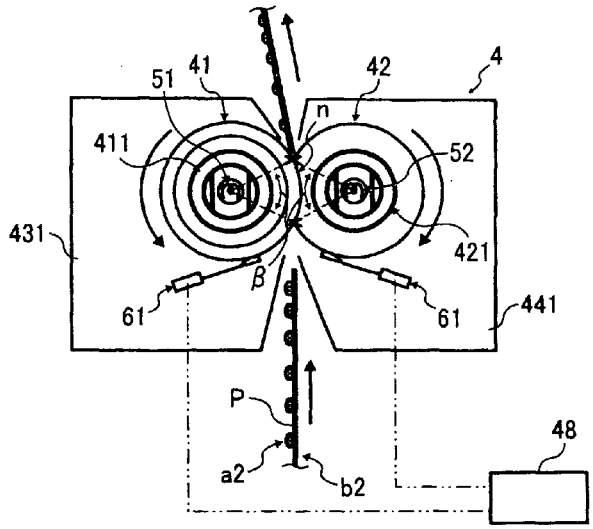
FIG. 4 is an explanatory view illustrating the location of a temperature sensing unit for a fixing roller and a pressing roller in the fixing device of FIG. 1.

As shown in FIG. 5, the fixing roller 41 and the pressing roller 42 have a feed area B1 of the maximum width along which the recording material P is fed in feed mode and non-feed areas B2 on both the sides outside the feed area B1. The outer circumferential surfaces of both the rollers are brought into pressurized contact with each other on the non-feed areas B2 to transmit rotational force to each other in the direction of feed. Note that as shown in FIGS. 4 and 5, the non-feed areas B2 are the outer surfaces of the fixing roller 41 and the pressing roller 42, to which contact type thermistors or a temperature sensing unit 61 for sensing the temperature of the respective surfaces are attached. Sensed signals from the temperature sensing unit 61 are delivered to the control unit 48. The control unit 48 corrects the reference value of the linear velocity of each outer circumferential surface of the fixing roller and the pressing roller on the basis of the linear velocity correction value corresponding to the sensed temperature of the respective outer surfaces. Note that it is also acceptable to replace the contact type thermistor by a non-contact type temperature sensing unit 61 such as an infrared sensor like thermopiles.

Figure 2:
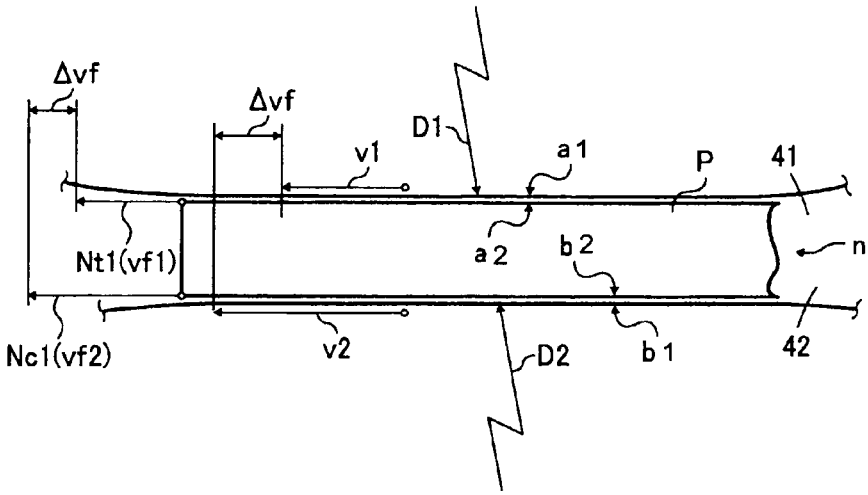
FIG. 2 is an explanatory view of the fixing function of the fixing device of FIG. 1.

Here, as shown in FIG. 2, the recording material P traversing the nip portion n may experience a linear speed difference $\Delta vf$ ($=|v2-v1|$) between the linear velocity vf1 of a surface a2 (image surface) carrying a toner image on the fixing roller 41 side and the linear velocity vf2 of a rear surface b2 on the pressing roller 42 side.

Here, in principle, if the fixing roller 41 and the pressing roller 42 have the same outer diameters D1 and D2 (see FIG. 5), the linear speed difference $\Delta v$ between the linear velocities v1 and v2 of the roller surfaces a1 and b1 is substantially zero. However, variations occur in the outer circumference length ($2\pi r2$) of the pressing roller 42 having an outer diameter D2 ($=2\times r2$) and the outer circumference length ($2\pi r1$) of the fixing roller 41 having an outer diameter D1 ($=2\times r1$). That is, when heated, the pressing roller 42 having the relatively thicker elastic layer 422 is more expanded and thus increased in outer diameter D1 than the fixing roller 41 having the relatively thinner elastic layer 412.

This results in the outer circumference length ($2\pi r2$) of the pressing roller 42 becoming greater than the outer circumference length ($2\pi r1$) of the fixing roller 41. Accordingly, at the same rotational speed (N/sec), the linear velocity v2 of the pressing roller 42 ($=2\pi r2\cdot N/sec$) is greater than the linear velocity v1 of the fixing roller 41 ($=2\pi r1\cdot N/sec$), leading to a linear velocity difference $\Delta v$ ($=v2-v1$).

Changes in temperature as mentioned above cause both the rollers to have the following variations that should be taken into account. That is, the variations may occur when a thin sheet or a recording material like an envelope having two or more sheets stacked with the ends glued together reaches the nip portion n. In these cases, the presence of the linear velocity difference $\Delta v$ may readily cause wrinkles on the recording material surface or unsettlement of images.

Furthermore, the frequency of occurrence of the aforementioned problems resulting from the development of the linear speed difference $\Delta v$ depends on the presence of toner on the rear surface between printing on the first recording material side a2 (image surface) and printing on the second side b2 (image surface).

The control unit 48 is provided with the following control properties by taking into account such variations.

Here, the control unit 48 acquires characteristic variations in the outer diameters corresponding to the temperatures of the fixing roller 41 and the pressing roller 42, thereby knowing the amount of change in outer diameter associated with temperature. As shown in FIG. 6, for example, to fix an ordinary sheet, the fixing roller 41 and the pressing roller 42 may be held at predetermined rotational speeds (values that are associated with the linear velocities v1 and v2 of the front and rear surfaces a1 and b1 corresponding to the rotational speed, respectively). In this case, suppose that at room temperatures or 23° C. in this example, the fixing roller 41 and the pressing roller 42 are driven, where the rollers have a diameter of 40 mm.

With this configuration, the variation characteristic diagram for the diameters D1 and D2 of the fixing roller 41 and the pressing roller 42 are determined according to increase or decrease in temperature of each roller.

Here, an increase in temperature causes the pressing roller 42 with a thicker elastic layer to expand to a diameter D2 larger than the diameter D1 of the fixing roller 41, thus increasing the diameter deviation ($+\delta D$). A decrease in temperature causes the pressing roller 42 with a thicker elastic layer to contract to a diameter smaller than the diameter D1 of the fixing roller 41. This leads to an increase in the diameter deviation ($-\delta D$), and when the temperature further decreases, the deviation remains constant.

Here, characteristics similar to those shown in FIG. 6 are determined for each recording material. Then, the reference rotational speeds Nt1 and Nc1 (not shown) are set for each recording material corresponding to the respective reference linear velocities (see vf1 and vf2 of FIG. 2). Furthermore, based on them, the target rotational speeds Nto ($=Nt1+\alpha1$) and Nco ($=Nc1+\alpha2$) of the front and rear surfaces a2 and b2 of each recording material P on the fixing roller 41 and the pressing roller 42 are set as the control velocity characteristic table as shown in FIG. 7.

As shown in FIG. 7, the control velocity characteristic table contains recording materials such as thick sheet, ordinary sheet, thin sheet, coated sheet, and envelopes. The control velocity characteristic table includes settings of the target rotational speeds Nto and Nco defined when each of these recording materials reaches from room temperatures to a constant average increased temperature value or 150° C. Here, as shown in FIG. 2, the surface of the fixing roller 41 opposing the recording material P is defined as a first side a1; the surface of the pressing roller 42 is defined as a first side b1; and the surfaces of the recording material P driven by frictional force created when it is pressed against the rollers are second sides a2 and b2. Here, FIG. 2 shows the rotational speeds Nto and Nco as those of the first sides a1 and b1 (on the roller sides), and the rotational speed Ntoj and Ncoj as those of the second sides a2 and b2 (on the recording sheet side).

Note that the control velocity characteristic table in FIG. 7 shows that the rotational speeds Nto and Nco of the first sides a1 and b1 and the rotational speeds Ntoj and Ncoj of the second sides a2 and b2 take on a value that is provided when the steady-state temperature range of 150° C. $\pm\theta$ ($\pm\theta$: tolerance) has been reached. Thus, in principle, the reference value (the rotational reference speed) for the linear velocity of each outer circumferential surface of the fixing roller 41 and the pressing roller 42 is corrected in accordance with a temperature deviation to prepare a plurality of control velocity characteristic tables (not shown) associated with a plurality of distribution ranges of each temperature. Then, the control velocity characteristic table that corresponds to the current temperature of the outer circumferential surface of each of the fixing roller 41 and the pressing roller 42 is selected. On the selected control velocity characteristic table, the rotational speeds Nto and Nco of the first sides a1 and b1 and the rotational speeds Ntoj and Ncoj of the second sides a2 and b2 are read.

Here, for thick sheet, ordinary sheet, and coated sheet, the speed of the first side b1 of the pressing roller 42, which is greater than the circumferential velocity of the first side a1 of the fixing roller 41 due to the expansion of the pressing roller 42, is suppressed, thereby correcting for the difference in linear velocity between both the rollers. Furthermore, for thick sheet, ordinary sheet, or coated sheet, the rotational speed Ncoj of the second side b2 on the recording material side is set, to a relatively high speed to adapt to an increased travel speed of a thick sheet, an ordinary sheet, or a coated sheet.

For the thin sheet that is easily wrinkled, each of the first sides a1 and b1 and the second sides a2 and b2 is fed at the same speed to add the relative speed difference to the thin sheet, thereby preventing the occurrence of wrinkles.

For the envelope, each of the first sides a1 and b1 and the second sides a2 and b2 is fed at the same speed while the rollers are being rotated at relatively low speeds, thereby preventing the material from being fed inappropriately (miss feed).

Note that with respect to the setting of the rotational speed of these recording materials, the reference value for the thick sheet, ordinary sheet, and coated sheet, which have a relatively low feed resistance and high shape retainability, is set to a value near 100 rpm. Meanwhile, the reference value for the envelope, which has a relatively high feed resistance and is easily deformable, is set to half that value, i.e., near 50 rpm. After that, the surface temperature of the outer surface of the pressing member is sensed with the temperature sensing unit 61. Then, the control unit 48 corrects the reference value (for example, 100 rpm) for the fixing member and the pressing member on the basis of the linear velocity correction value $\beta(t)$ corresponding to the sensed temperature of the respective outer surfaces. Thus, the values as shown in the control velocity characteristic table are determined and set.

The control unit 48 of the fixing device 4 of FIG. 1 operates in a fixing warm-up mode when the main power supply of the printer M1 is in an ON state.

In the fixing warm-up mode, the surface temperature of the fixing roller 41 and the pressing roller 42 is sensed with the contact type thermistor serving as the temperature sensing unit 61 to drive, as required, the heating units 51 and 52 of a halogen heater to keep the rollers at the predefined standby temperature.

Before the start switch is turned ON, the control unit 48 turns OFF an electromagnetic solenoid 456 of the switching unit C1 incorporated in the fixing drive unit 45 on the fixing roller 41 side, and switches a movable idler wheel gear 453 to the separation point P2 and holds the gear 453 at the point P2. The control unit 48 then separates the fixing roller 41 from a stepping motor 455, allowing the fixing roller 41 to be rotationally driven by the pressing roller 42 that is in pressurized contact therewith. At this time, the fixing roller 41 feeds no sheet. The fixing roller 41 driven by the pressing drive unit 46 and the pressing roller 42 rotate in pressurized contact with each other with the maximum width B, whereby the rollers transmit rotational force to each other in the direction of feed and heat each other uniformly. Note that during standby after the heating step, the pressing drive unit 46 on the pressing roller 42 side rotates intermittently at a low speed in the standby mode.

When the start switch is turned ON, the electromagnetic solenoid 434 disposed in the fixing drive unit 45 on the fixing roller 41 side is turned ON to switch the movable idler wheel gear 453 to the connection point P1 and hold the gear 453 at the point P1. The stepping motor 415 drives the fixing roller 41 and a stepping motor 425 drives the pressing roller 42, so that both the rollers 41 and 42 are driven at their predetermined respective rotational speeds in pressurized contact with each other with the maximum width B.

At this time, the sheet feeding device 2, the exposing unit 34, and the transfer device 3 in the image forming apparatus shown in FIG. 3 are sequentially driven to form a recording material P carrying an unfixed color toner image, and the resulting recording material P is fed to the fixing device 4.

In this case, the control unit 48 determines which type of the recording materials P (including transfer material such as transfer paper, recording sheets, OHP film sheets, and envelopes) are used this time on the basis of information from the sheet feeding device 2.

Furthermore, the control unit 48 determines whether the first side a1 of the fixing roller and the first side b1 of the pressing roller are heated into a steady state and whether the measured surface temperature has fallen within the steady-state temperature range of 150° C. ±θ (±θ: tolerance). If the temperature range has been reached, the control unit 48 controllably drives the fixing drive unit 45 on the fixing roller 41 side and the pressing drive unit 46 on the pressing roller 42 side according to the type of the current recording material P to hold the rotational speeds Nto and Nco of the first sides a1 and b1. Here, the surface of the fixing roller is the first side a1, the surface of the pressing roller is the first side b1, and the surfaces of the recording material in pressurized contact with the first sides are the second sides a2 and b2.

As described above, with the steady-state temperature range of 150° C. ±θ (±θ: tolerance) having been reached on the surfaces of the fixing roller and the pressing roller, control is provided to hold the rotational speeds Nto and Nco of the first sides a1 and b1 according to the type of the recording material P (including transfer material such as transfer paper, recording sheets, OHP film sheets, and envelopes). This control allows the rotational speeds Ntoj and Ncoj of the second sides a2 and b2 of the recording material to be held at a value close to those in the control velocity characteristic table shown in FIG. 7, thereby feeding the recording material in a proper manner. On the other hand, if the surfaces of the fixing roller and the pressing roller are not within the steady-state temperature range of 150° C. ±θ, then a control velocity characteristic table corresponding to the temperature of each outer circumferential surface of the pressing roller 42 is selected.

After that, on the basis of the control velocity characteristic table thus selected, the rotational speeds Nto and Nco of the first sides a1 and b1 and the rotational speeds Ntoj and Ncoj of the second sides a2 and b2 are read. Then, control is provided to the rotational motions of the fixing drive unit 45 on the fixing roller 41 side and the pressing drive unit 46 on the pressing roller 42 side to achieve the rotational speeds Nto and Nco of the first sides a1 and b1.

This allows for reducing the feed speed difference between the second sides a2 and b2 (the front and rear surfaces) of the recording material P to suppress stoppage of feed and unsettlement of images. It is thereby ensured to prevent occurrence of wrinkles due to the relative speed difference between the front and rear surfaces of various types of recording materials. Furthermore, the control velocity characteristic table can be selected according to the temperature of the fixing roller and the pressing roller and used as the target value to correct the linear velocity of each outer circumferential surface. This further ensures it to improve flexibility for fixing images on a plurality of types of recording materials.

As shown in FIG. 4, the temperature sensing unit is located on the non-feed areas B2 outside the feed area. It is thus possible to reduce (ignore) the effects that are caused by the surface temperature being excessively lowered while sheets are being fed continuously. This reliably improves flexibility for fixing images on a plurality of types of recording materials.

Also, as shown in FIG. 3, the contact type thermistor is employed as the temperature sensing unit. This configuration improves flexibility for fixing images on a plurality of types of recording materials at low costs.

Furthermore, the stepping motor can be employed as the driving unit to provide more accurate control to rotational speeds. This further reliably improves flexibility for fixing images on a plurality of types of recording materials.

Furthermore, the printer M1 equipped with the belt fixing device 4 of the first embodiment is provided with the switching unit C1 at some midpoint of the fixing drive unit 45 for the fixing roller 41. Thus, in the feed mode, control can be provided to drive each outer circumferential surface of the fixing member and the pressing member at their respective independent linear velocities so that the switching unit C1 maintains the connection point P1 to reduce the feed speed difference between the front and rear surfaces of the recording material. In the non-feed mode, the switching unit C1 maintains the separation point P2 to drive either one of the fixing member and the pressing member, i.e., the pressing drive unit 46 on the pressing roller 42 side in the first embodiment of FIG. 1, causing the fixing roller 41 to be idled and driven to rotate. This reduces relative frictional force and ensures the durability of the fixing member and the pressing member.

While the present invention has been described with reference to an embodiment, the invention is not limited to the specific configuration of the aforementioned embodiment but may take any configuration without departing from the scope and spirit of the appended claims.

Figure 8:
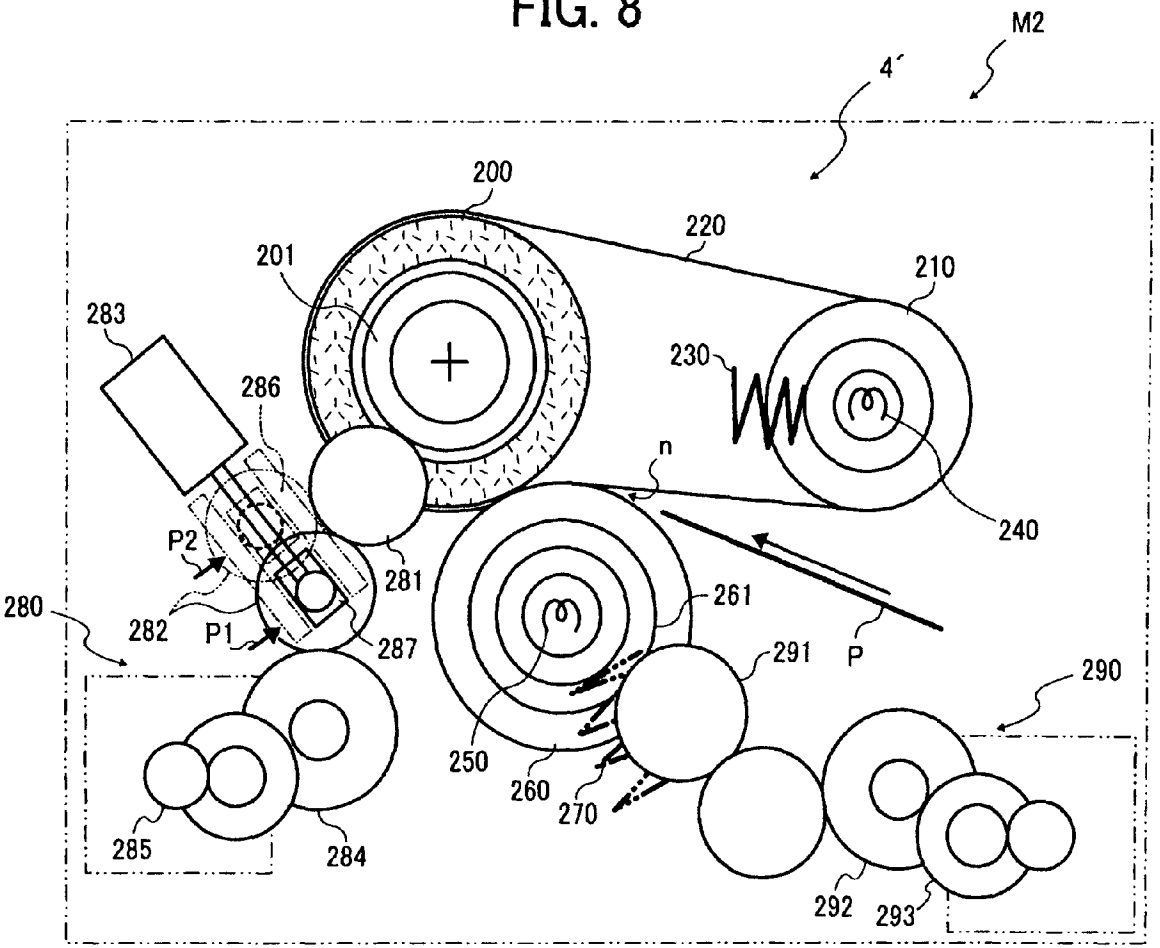
FIG. 8 is a schematic cross-sectional side view of a fixing device according to another embodiment of the fixing device of FIG. 1.

For example, the first embodiment has been described as being applied to the printer M1 with the fixing device 4 which brings the fixing member and the pressing member into pressurized contact with each other for application of heat and pressure. However, the present invention may also be applied to a printer (not shown) which includes a belt fixing device 4' according to a second embodiment as shown in FIG. 8. This configuration provides a fixing member having an endless belt 220 wound around a fixing roller 200 and a heating roller 210, and uses a pressing unit 270 to bring a pressing roller 260 into pressurized contact with the fixing roller 200 around which the endless belt 220 is wound. Here, the nip n is formed at the pressurized contact portion between the fixing roller 200 and the pressing roller 260 and receives the recording sheet P to be fed to fix images thereon. Furthermore, the pivotally supporting portion of the heating roller 210 is provided with a pressing unit 230 for giving tensile force to the endless belt 220. Furthermore, the hollow shafts of the heating roller 210 and the pressing roller 260 are provided with heat sources 240 and 250. With this configuration, the fixing roller 200 and the pressing roller 260 are rotationally driven by separate driving units 280 and 290, respectively.

The driving unit 280 and 290 are configured in the same manner as described in relation to FIG. 1. The driving unit 280 provided for the fixing roller 200 in pairs includes an idler wheel 281 mating with a drive gear 201 integrated with the fixing roller 200, a movable idler wheel 282, a reduction gear 284, and a driving motor 285, which are connected to each other in that order. The driving unit 280 also includes a switching unit Cb for switching the movable idler wheel 282 between the connection point P1 and the separation point P2. The switching unit Cb includes an electromagnetic solenoid 283, a guide rail 286, and a slider 287 guided along the guide rail 286 to pivotally support the rotating shaft of the movable idler wheel 282. The electromagnetic solenoid 283 switches the movable idler wheel 282 between the connection point P1 and the separation point P2 according to a connection/separation output signal from a control unit (not shown). This switching operation provides a changeover between one mode in which the driving motor 285 is rotated to drive the fixing roller 200 and the other mode in which the fixing roller 200 is driven by the pressing roller 260.

On the other hand, as described in relation to FIG. 1, the pressing roller 260 has a driving unit 290 provided in pairs. The driving unit 290 includes a plurality of idler wheels 291 mating with a drive gear 261 integrated with the pressing roller 260, a reduction gear 292, and a driving motor 293, which are linked together in that order. The pressing roller 260 is configured to be continuously driven by the rotary motion of the driving motor 285 only when having received a drive signal from a control unit 710.

The printer M2 equipped with the belt fixing device 4' of the second embodiment is also provided with the switching unit Cb at some midpoint of the driving unit 280 of the fixing roller 200. This configuration allows the electromagnetic solenoid 283 to switch the movable idler wheel 282 between the connection point P1 and the separation point P2 according to a connection/separation output signal from the control unit 710. This switching operation provides a changeover between one mode in which the driving motor 285 is rotated to drive the fixing roller 200 and the other mode in which the fixing roller 200 is driven by the pressing roller 260. This achieves the same effects as previously described for the fixing device of FIG. 1.

Furthermore, the present invention may be applied to not only the printer or an MFP including the printer but also a facsimile machine as well as an image forming apparatus which includes an MFP having a combination of at least a facsimile machine and a printer. In this case also, it is possible to achieve basically the same effect as previously described for the fixing device of FIG. 1.

According to an embodiment of the present invention, the rotational speed of each of the fixing member and the pressing member is set appropriately in the feed mode. This makes it possible to provide a fixing device with improved flexibility to a plurality of types of recording materials without degrading the service life of the fixing member and the pressing member.

According to an embodiment, the rotational speed of each of the fixing member and the pressing member is set appropriately in the feed mode. This facilitates the control of the control unit to handle image fixation onto a plurality of types of recording materials without degrading the service life of the fixing member and the pressing member.

According to an embodiment, with respect to the linear velocity of each outer circumferential surface, a reference value is set depending on the type of the recording material and the characteristics of the front and rear surfaces. This facilitates the control to maintain the relative speed difference in the linear velocity between the outer circumferential surfaces of the fixing member and the pressing member at a proper value.

According to an embodiment, the linear velocity of each outer circumferential surface is corrected in accordance with the temperature of the fixing member and the pressing member. This reliably improves flexibility for fixing images on a plurality of types of recording materials.

According to an embodiment, even when at least one of the fixing member and the pressing member is a roller, the same effects as described above can be achieved.

According to an embodiment, the temperature sensing unit is located outside a feed area. This makes it possible to reduce (ignore) the effects that may be caused by drops in surface temperature of the fixing member and the pressing member due to passing recording materials. This further reliably improves flexibility for fixing images on a plurality of types of recording materials.

According to an embodiment, the contact type thermistor can be used for the temperature sensing unit, whereby improved flexibility can be realized for fixing images on a plurality of types of recording materials at low costs.

According to an embodiment, the driving unit can be a stepping motor to provide controlled rotational speed with improved accuracy. This further reliably improves flexibility for fixing images on a plurality of types of recording materials.

According to an embodiment, it is possible to provide an image forming apparatus including the fixing device as described above.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing device comprising:

a fixing member including a first heater;

a pressing member including a second heater, the fixing member and the pressing member defining a nip portion where an unfixed toner image is fixed on an image surface of a recording material;

a driver configured to individually control linear velocities of outer circumferential surfaces of the fixing member and the pressing member; and a controller configured to control the driver based on temperatures of the outer circumferential surfaces of the fixing member and pressing member, wherein, in a feed mode in which the outer circumferential surfaces sandwich the recording material to fix the image on the recording material, the driver is configured to drive the fixing member and the pressing member such that the outer circumferential surfaces move at individual linear velocities to reduce a feed speed difference between front and rear surfaces of the recording material and the controller is configured to control the driver to drive the outer circumferential surfaces of the fixing member and the pressing member at individual linear velocities to reduce the feed speed difference between the front and rear surfaces of the recording material, and in a non-feed mode, the driver is configured to drive at least one of the fixing member and the pressing member and the controller is configured to control the driver to drive the at least one of the fixing member and the pressing member such that the other member is driven by the at least one member.

2. The fixing device according to claim 1, wherein a reference value of a linear velocity of each of the outer circumferential surfaces of the fixing member and the pressing member is set depending on a type of the recording material and characteristics of the front and rear surfaces.

3. The fixing device according to claim 1, wherein at least one of the fixing member and the pressing member includes a roller.

4. The fixing device according to claim 1, wherein the driver includes a stepping motor.

5. An image forming apparatus comprising:

a fixing device according to claim 1.

6. A fixing device comprising:

a fixing member including a first heater;

a pressing member including a second heater, the fixing member and the pressing member defining a nip portion where an unfixed toner image is fixed on an image surface of a recording material;

a driver configured to individually control linear velocities of outer circumferential surfaces of the fixing member and the pressing member;

a controller configured to control the driver based on temperatures of the outer circumferential surfaces of the fixing member and pressing member;

at least one temperature sensor adjacent to the outer circumferential surface of the fixing member and configured to sense the temperature of the outer circumferential surface of the fixing member; and at least one temperature sensor adjacent to the outer circumferential surface of the pressing member and configured to sense the temperature of the outer circumferential surface of the pressing member, wherein in a feed mode in which the outer circumferential surfaces sandwich the recording material to fix the image on the recording material, the driver is configured to drive the fixing member and the pressing member such that the outer circumferential surfaces move at individual linear velocities to reduce a feed speed difference between front and rear surfaces of the recording material, in a non-feed mode, the driver is configured to drive at least one of the fixing member and the pressing member, a reference value of a linear velocity of each of the outer circumferential surfaces of the fixing member and the pressing member is set depending on a type of the recording material and characteristics of the front and rear surfaces, and the controller is configured to correct the reference value of the linear velocity of each of the outer circumferential surfaces of the fixing member and the pressing member based on a linear velocity correction value corresponding to the sensed temperatures of the outer circumferential surfaces of the fixing member and the pressing member.

7. The fixing device according to claim 6, wherein at least one of the temperature sensor adjacent the fixing member and the temperature sensor adjacent the pressing member is located outside a feed area, and the temperatures sensed by the temperature sensors adjacent the outer circumferential surfaces of the pressing member and the fixing member determines the linear velocity correction value.

8. The fixing device according to claim 7, wherein the at least one temperature sensor located outside the feed area is a contact-type thermistor.

* * * * *